United States Patent [19]

Daussan et al.

[11] 4,202,533

[45] May 13, 1980

[54] METHOD AND A DEVICE FOR UNCHOKING THE CASTING OUTLET OF A METALLURGICAL VESSEL

[75] Inventors: Jean-Charles Daussan; Gérard Daussan, both of Metz; André Daussan, Longeville-les-Metz, all of France

[73] Assignee: Daussan et Compagnie, Woippy, France

[21] Appl. No.: 948,762

[22] Filed: Oct. 3, 1978

[30] Foreign Application Priority Data

Aug. 24, 1978 [FR] France ..... 78 24555

[51] Int. Cl.[2] ..... B22D 11/10; B22D 32/00

[52] U.S. Cl. ..... 266/45; 164/82; 266/236; 266/271

[58] Field of Search ..... 266/45, 271, 272, 236; 164/82, 66

[56] References Cited

U.S. PATENT DOCUMENTS

| | | | |
|---|---|---|---|
| 3,743,139 | 7/1973 | Lyman | 266/236 |
| 3,794,218 | 2/1974 | Yanagida et al. | 266/45 |
| 3,809,146 | 5/1974 | Andrzajak et al. | 164/82 |
| 3,823,931 | 7/1974 | Wells et al. | 266/45 |
| 3,982,582 | 9/1976 | Knorr et al. | 266/236 |
| 4,003,561 | 1/1977 | Cudby | 266/236 |
| 4,007,035 | 2/1977 | Smith | 266/45 |
| 4,079,918 | 3/1978 | Truppe et al. | 266/45 |

*Primary Examiner*—L. Dewayne Rutledge
*Assistant Examiner*—Peter K. Skiff
*Attorney, Agent, or Firm*—Young & Thompson

[57] ABSTRACT

In order to unchoke the casting outlet of a vessel such as a casting ladle fitted with a casting tube for transferring molten metal to a tundish, a feed pipe is engaged in a lateral opening formed in the upper portion of the casting tube and guided within the tube until the end of the feed pipe opens in the vicinity of the casting outlet. The feed pipe is then connected to a supply of oxygen or similar oxidizing gas which is discharged in a jet onto the mass of solidified metal which obstructs the outlet. After the outlet has been cleared by melting of the mass of metal, the feed pipe is withdrawn and the lateral opening of the casting tube is sealed-off.

9 Claims, 7 Drawing Figures

FIG_1
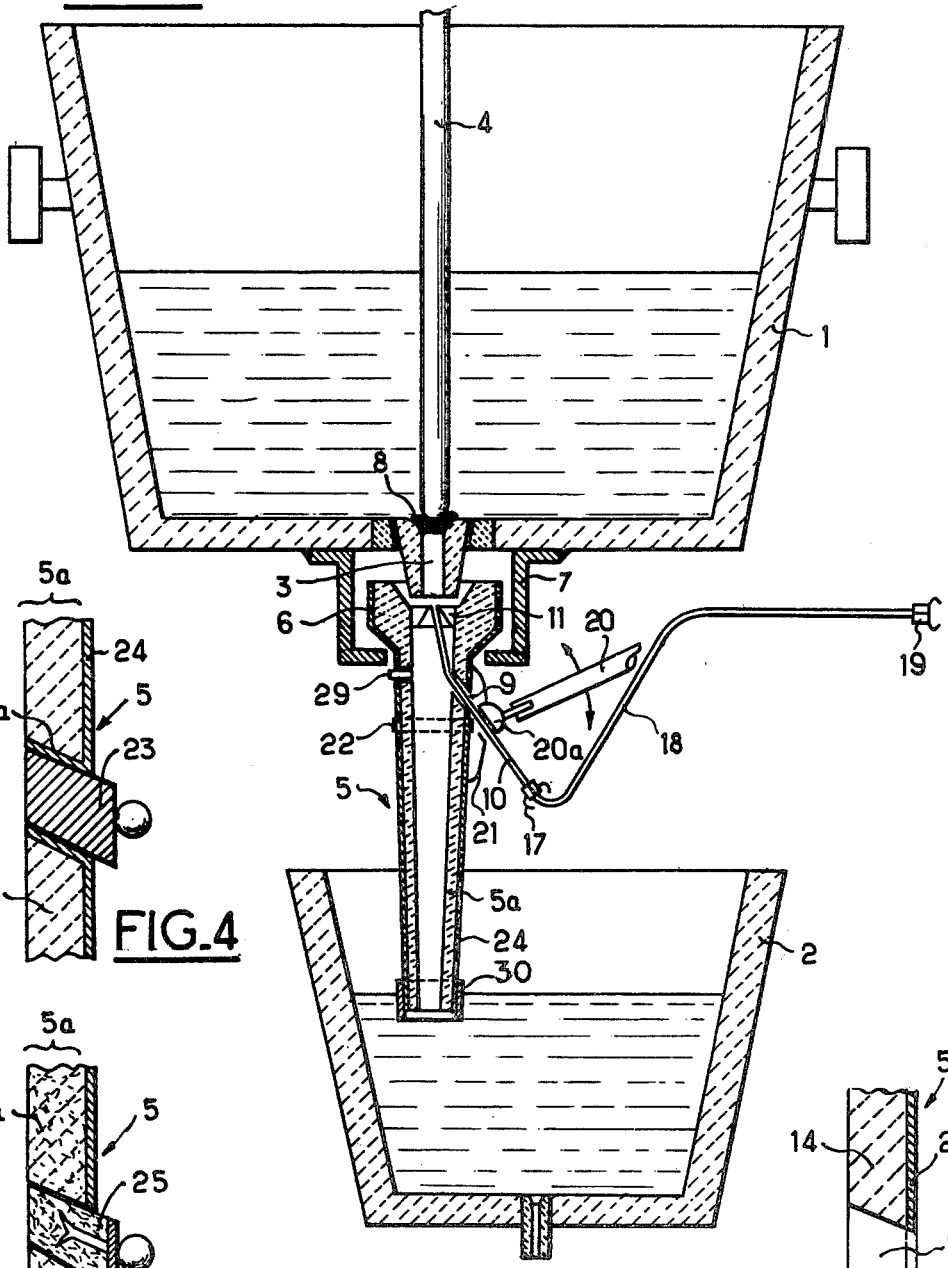
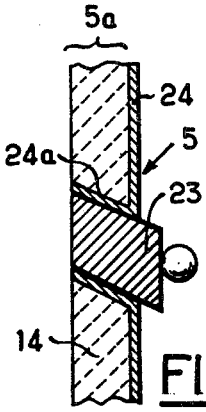
FIG_4
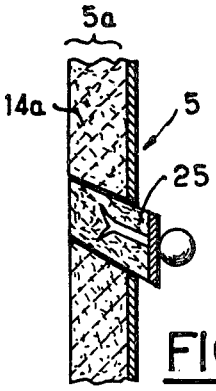
FIG_5
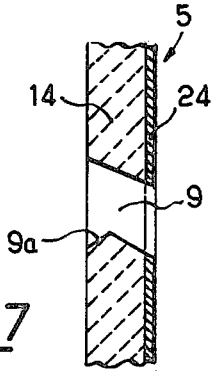
FIG_7

METHOD AND A DEVICE FOR UNCHOKING THE CASTING OUTLET OF A METALLURGICAL VESSEL

This invention relates to a method for unchoking the casting outlet of a metallurgical vessel fitted with a casting tube.

A further aim of the invention is to provide a device for the practical application of the method aforesaid.

The invention is primarily directed to a method and a device for unchoking the casting outlet of a casting ladle fitted with a casting tube which is placed between said outlet and a tundish, the lower portion of said tube being immersed in the molten metal which is transferred into said tundish.

A casting tube of the type mentioned above serves to prevent any projection of molten metal resulting from the pouring operation and to limit oxidation of the metal and cooling of the latter by the surrounding atmosphere during its transfer from the casting ladle into the tundish.

When the operation which consists in filling casting ladles with molten metal is first begun, said molten metal comes into contact with the cold walls of the ladle and is liable to undergo partial solidification, especially at the level of the casting outlet of said ladle. In consequence, it proves necessary to unchoke the casting outlet by directing a jet of oxygen into the latter from underneath. This operation can be performed only after removal of the casting tube in order to allow access to the casting outlet by a torch which utilizes oxygen or a suitable oxidizing gas. When provision is not made for a casting tube, the operation which consists in unchoking the casting outlet becomes extremely hazardous since unchoking is liable to take place in an untimely manner and to result in a discharge of molten metal at a flow rate which cannot immediately be controlled by means of the closure device, this device being usually a stopper rod placed above the casting outlet.

This uncontrolled discharge represents a major hazard for any workers who may be present in the vicinity of the jet of molten metal.

Moreover, the need to remove the casting tube prior to unchoking of the casting outlet and then to replace this tube after the unchoking operation has been completed results in a considerable waste of time in the performance of the casting operation.

It is clearly unthinkable to carry out unchoking of the casting outlet without removing or without displacing the casting tube. The very length of these tubes and the fact that these latter penetrate into the interior of the tundish or continuous-casting ingot mold placed beneath the casting vessel make it impossible to engage a torch of the oxygen or oxidizing gas type from underneath and within the interior of the casting tube.

The aim of the present invention is to provide a method and a device which considerably facilitate unchoking of the casting outlet of a vessel used for transferring molten metal and provided with a casting tube while ensuring a high level of safety for personnel to whom the task of unchoking is assigned.

In accordance with the invention, this method is characterized by the following steps:

a feed pipe is engaged in an opening formed in the lateral wall of the casting tube in the vicinity of the top portion of the latter, said feed pipe is guided within the interior of the casting tube in such a manner as to ensure that the end of said feed pipe opens in the vicinity of the casting outlet to be unchoked, said feed pipe is connected to a supply of oxygen or of similar oxidizing gas in order to melt the solidified metal which chokes the casting outlet, the feed pipe is withdrawn and the lateral opening of the casting tube is sealed-off.

This method makes it possible to unchoke the casting outlet without removing the casting tube, thus considerably facilitating the unchoking operation and ensuring absolute safety of personnel entrusted with the task of unchoking.

The feed pipe mentioned above can be placed in position prior to casting of the metal or at any moment during the casting operation after closure of the casting outlet.

Closure of the lateral opening of the casting tube forestalls any danger of leakage of molten metal or of oxidation of the latter through said opening.

A further aim of the invention is to provide a device for carrying out the method which has been outlined in the foregoing.

The device under consideration essentially comprises an opening formed in the lateral wall of the casting tube, preferably in the upper portion of the latter, a feed pipe for supplying oxygen or a suitable oxidizing gas which is intended to be introduced into the casting tube through the lateral opening aforesaid, means for guiding said feed pipe towards said casting outlet and a plug for sealing-off the lateral opening aforesaid after withdrawal of the feed pipe.

In an advantageous embodiment of the invention, the feed pipe for supplying oxygen or like oxidizing gas is elbowed and the lateral opening is inclined towards the top portion of the casting tube. Nevertheless the lateral opening can be extended to practically the full height of the feed pipe.

By virtue of these arrangements, it is possible to make use of a relatively short feed pipe which can be engaged in a lateral opening placed near the top edge of the casting tube.

In a preferred embodiment of the invention, the means for guiding the feed pipe which serves to supply oxygen or like oxidizing gas comprise a funnel which readily melts in contact with the liquid metal and is inserted in the top portion of the casting tube, said funnel being flared towards the bottom of said casting tube.

Said downwardly-flared funnel is placed within the casting tube prior to commencement of the casting operation. Said funnel melts in contact with the liquid metal as soon as unchoking has been completed. Thus said funnel is not liable to hinder the flow of metal.

Further distinctive features and advantages of the invention will become apparent from the description which now follows, reference being made to the accompanying drawings which are given by way of example and not in any sense by way of limitation, and wherein:

FIG. 1 is a longitudinal sectional view of a casting installation equipped with an unchoking device in accordance with the invention;

FIG. 4 is a fragmentary longitudinal sectional view of a casting tube, the lateral opening of said tube being sealed-off by means of a plug in accordance with one form of construction given by way of example;

FIG. 5 is a view which is similar to FIG. 4 and relates to another example of construction of a sealing plug;

FIG. 7 is a view which is similar to FIGS. 4 and 5 and shows another design of lateral opening of the casting tube.

Figure 2:
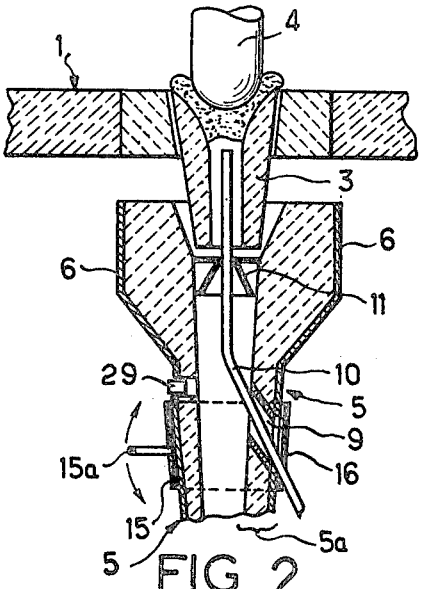
FIG. 2 is a fragmentary longitudinal sectional view to a larger scale showing an unchoking device introduced into a casting tube.

The unchoking device in accordance with the invention will first be described.

The method in accordance with the invention will then be described at the same time as the operation of the unchoking device aforesaid.

The casting installation shown in FIG. 1 comprises a casting ladle 1 placed above a tundish 2. The bottom of the casting ladle 1 is provided with a nozzle 3 which constitutes the casting outlet of said ladle. Above the nozzle 3 is placed a stopper rod 4 for opening or closing the casting outlet and regulating the rate of flow of molten metal through said casting outlet.

Beneath the casting nozzle 3 is placed a casting tube 5, the lower end of which is immersed in the tundish 2.

The upper end of the casting tube 5 has two widened lateral portions 6 for removably fixing said upper end of the casting tube 5 within a support 7 in much the same manner as an eccentric, said support being attached to the bottom wall of the casting ladle 1 beneath the casting nozzle 3.

There is shown in FIG. 1 a mass of solidified metal 8 which closes and chokes the casting nozzle 3.

The device in accordance with the invention for unchoking the casting nozzle 3 comprises an opening 9 formed in the lateral wall 5*a* of the casting tube 5 in the vicinity of the top portion of the latter, an oxygen feed pipe 10 which is introduced into the casting tube 5 through the lateral opening 9 aforesaid, and a member 11 for guiding said feed pipe 10 towards the casting outlet 3.

From FIGS. 1 and 2, it is apparent that the oxygen feed pipe 10 is elbowed at an angle of the order of 120° and the lateral opening 9 of the casting tube 5 is inclined towards the casting nozzle 3.

It is further apparent from FIGS. 1 and 2 that the member 11 for guiding the feed pipe 10 towards the casting nozzle 3 is constituted by a funnel which is flared in the downward direction, that is, towards the lower end of the casting tube 5. Said funnel 11 is inserted in the top portion of the casting tube 5 prior to positioning of the latter within the support 7. Said funnel 11 is formed of a metal such as relatively thin sheet steel which melts in contact with the liquid metal as the latter is discharged through the casting nozzle 3.

Figure 3:
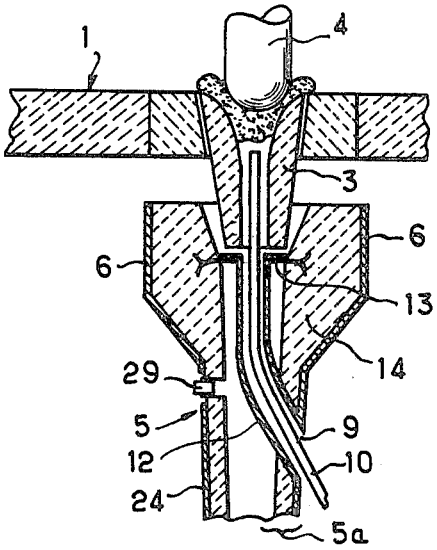
FIG. 3 is a view which is similar to that of FIG. 2 and shows another embodiment of the device in accordance with the invention.

In the embodiment of FIG. 3, the funnel 11 is replaced by an elbowed sleeve 12 placed between the lateral opening 9 of the casting tube 5 and secured to the upper portion of the latter by means of an annular flange 13 which is anchored in the internal lining 14 of the casting tube 5. As in the case of the funnel 11, the sleeve 12 is made of sheet steel or other materials of relatively small thickness and capable of melting at the time of discharge of the molten metal through the casting tube 5.

In the example of FIG. 2, the casting tube 5 is surrounded by a sleeve 15 having an orifice 16 located opposite to the lateral opening 9 of the casting tube 5. Said sleeve 15 is rotatably mounted on the tube 5. After withdrawal of the feed pipe 10, rotational displacement of said sleeve 15 by means of its handle 15*a* has the effect of moving the orifice 16 of said sleeve 15 away from the lateral opening 9 of the casting tube 5, with the result that the latter is thus closed-off.

As also shown in FIG. 1, the elbowed oxygen feed pipe 10 is connected by means of a quick-action coupling 17 to a pipe 18 which extends to the outlet 19 of an oxygen cylinder. In the embodiment described in FIG. 1, provision is also made for a lever 20 which is pivotally attached to a support bracket 21, said bracket being secured to the casting tube 5 by means of a strap 22. The extremity 20*a* of the lever 20 is adapted to cooperate in frictional contact with the feed pipe 10, with the result that the latter can be progressively displaced within the interior of the casting tube 5 by actuating said lever 20.

The lining 14 which covers the interior of the casting tube 5 can be of conventional refractory material. However, said lining 14 is preferably made of heat-insulating material of the type described in French patent application No. 75 36832 filed in the name of the present applicant.

This material contains inorganic particles embedded in an organic or inorganic binder. Said inorganic particles are sinterable under the action of the heat generated within the casting tube during the passage of molten metal. This sintering action explains the high resistance of the lining 14 which is in contact with the molten metal.

In the event that the lining 14 of the casting tube 5 is of conventional refractory material, closure of the lateral opening 9 of the casting tube 5 can be ensured after withdrawal of the feed pipe 10 by means of a metallic plug 23 as indicated in FIG. 4. In this embodiment, the metal cladding 24 which covers the external wall of the casting tube 5 also covers the wall of the lateral opening 9 at 24*a*. The technical effect achieved by this distinctive feature will be discussed in detail below in the description relating to the operation of the device according to the invention.

In the event that the lining 14*a* (see FIG. 5) is of heat-insulating material composed of sinterable inorganic particles, it is an advantage to ensure that the plug 25 is fabricated from the same sinterable material as that of the lining 14*a*. In this case the wall of the lateral opening 9 of the casting tube 5 is not covered by the metallic cladding 25 for reasons which will be explained below in the description which deals with the operation of the device in accordance with the invention.

In the embodiments described in the foregoing, the device in accordance with the invention is applied to the case in which closure of the casting nozzle 3 is performed by means of a stopper rod 4.

Figure 6:
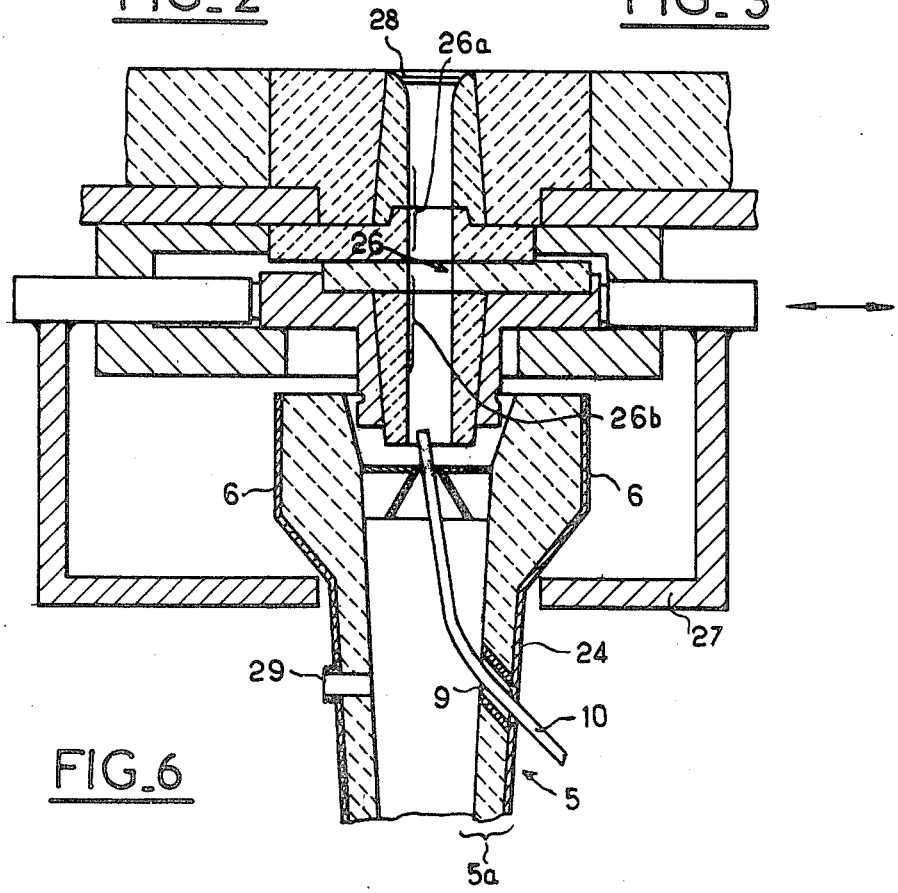
FIG. 6 is an axial sectional view showing an unchoking device which is similar to that of FIG. 2, said device being placed beneath a casting outlet equipped with a slide-valve nozzle.

As can readily be understood, the unchoking device in accordance with the invention is also applicable to the case of a metallurgical vessel such as a casting ladle or tundish having a casting outlet fitted with a nozzle 26 of the slide-valve type as indicated in FIG. 6. This slide-valve nozzle 26 has a stationary upper section 26*a* and a movable lower section 26*b* which is capable of translational displacement with respect to said stationary upper section 26*a*. In FIG. 6, these two sections 26*a* and 26*b* are located in the line of extension of each other so as to provide a free and unobstructed passageway for the flow of metal. In this embodiment, the casting tube 5 is secured to the movable lower section 26b of the slide-valve nozzle 26 by means of a support 27, with the result that the casting tube 5 undergoes displacement at the same time as the aforementioned movable section 26b.

In the case of the example which is illustrated, the slide-valve nozzle 26 is closed-off by means of a metallic disc-plug 28 which is fitted in position within the casting ladle prior to filling of the latter. The application of the device in accordance with the invention dispenses with the need for said disc-plug 28.

The operation of the unchoking device and the practical application of the method in accordance with the invention will now be described first of all with reference to FIG. 1.

In order to unchoke the nozzle 3 or in other words to remove the mass of solidified metal 8 from the latter, the procedure is as follows:

The oxygen feed pipe 10 is engaged within the lateral opening 9 of the casting tube 5. Said feed pipe 10 is then guided within the interior of the casting tube 5 in such a manner as to ensure that said feed pipe 10 opens into the casting nozzle 3. The engagement of said oxygen feed pipe 10 within the casting tube 5 is facilitated by the articulated lever 20. Accurate positioning of the extremity of the feed pipe 10 and correct orientation of the latter towards the nozzle 3 are ensured by means of the funnel 11, by virtue of the fact that said feed pipe 10 is elbowed and that the opening 9 is inclined towards the upper end of the casting tube 5.

When the feed pipe 10 is in position, said pipe is connected to the oxygen supply pipe 18. A jet of oxygen is then directed towards the solidified mass 8. This mass is at a high temperature and is therefore caused to melt under the action of the oxygen. Since the mass of metal 8 has thus been eliminated, the molten metal contained in the casting ladle 1 is thus immediately released. As this molten metal flows down through the casting tube 5, it comes into contact with that portion of the feed pipe 10 which is engaged within the casting tube 5 and which then melts. It only remains necessary at this point to withdraw the remaining portion of the feed pipe 10 which has not melted, then to seal-off the opening 9 of the lateral wall 5a of the casting tube 5.

This operation is carried out in the case of FIG. 2 by rotating the sleeve 15 around the casting tube 5 in such a manner that said sleeve entirely covers the lateral opening 9.

In the case of FIGS. 4 and 5, closure of the lateral opening 9 of the casting tube 5 is carried out by means of the plugs 23 and 25. By virtue of the fact that the plug 23 shown in FIG. 4 is of metal, the surface of said plug which is adjacent to the interior of the casting tube 5 melts to a partial extent under the action of the heat generated as the molten metal passes down said tube, with the result that the plug 23 is welded to the metal cladding 24. A perfect bond is thus obtained between the plug 23 and the casting tube 5.

In the case of FIG. 5, the fact that the plug 25 is formed of sinterable material of the same type as the material of the lining 14a results in welding of the material of the plug 25 to the material of the lining 14a by sintering of the inorganic particles contained therein under the action of the heat generated when the molten metal passes through the casting tube 5. Sintering between the materials of the plug 25 and of the lining 14a also makes it possible to form an excellent bond between the plug 25 and the casting tube 5.

As will be readily apparent, the invention is not limited to the examples described in the foregoing and many modifications can accordingly be contemplated without thereby departing either from the scope or the spirit of the invention.

Thus it follows that the lateral wall 5a of the casting tube 5 can also be provided with an opening or with a connecting-nipple 29 which serves to connect a pipe for supplying a neutral gas such as argon or alternatively a reducing gas in order to remove any potential danger of oxidation of the liquid metal.

Moreover, the opening 9 can also have a wall constituted by a downwardly-inclined portion 9a which is adjacent to the interior of the casting tube 5 in order to limit the danger of flow of molten metal to the exterior of the casting tube 5 prior to complete closure of the opening 9 (as shown in FIG. 7).

Closure of the opening 9 can also be effected by means of a curtain of neutral gas such as argon which is placed opposite to said opening 9 either externally or internally of the casting tube 5.

The lateral opening 9 can also be extended to practically the full height of the casting tube 5 whilst a sleeve 30 can advantageously be fitted at the lower end of said tube. Said sleeve can be metallic and/or of heat-insulating material and/or of refractory material (see FIG. 1).

Heat-insulating and/or refractory casting tubes 5 can also be delivered to the user with a stationarily fixed oxygen feed pipe 10 which can be fitted with a quick-action coupling 17. It is only necessary to adapt the cross-sectional area of the lateral opening 9 or of the sleeve 12 to the cross-sectional area of the feed pipe 10 so as to ensure that the latter is not uncoupled during transportation. This clamping action is obtained by reducing the diameter of the opening 9 of FIG. 6 or of the sleeve 12 of FIG. 3 with respect to the diameter of the feed pipe 10.

At the time of utilization of the device in accordance with the invention, the casting tube 5 is stationarily mounted beneath the nozzle 3, 26b, the feed pipe 10 being engaged in the lower end of the nozzle 3 shown in FIGS. 1, 2 and 3 or of the nozzle 26b shown in FIG. 6. If it becomes apparent at the moment of pouring, that is to say at the time of opening of the nozzle 3, 26b, that the metal does not flow out of the vessel 1, it is necessary only to thrust the feed pipe 10 further inwards in the direction of the mass of solidified metal 8 and to discharge the jet of oxygen in order to eliminate said mass by melting. As it comes into contact with the molten metal which flows within the casting tube 5, that portion of the feed pipe 10 which is encaged within the casting tube 5 melts. It is then necessary only to withdraw the remainder of the feed pipe 10 and to close-off the opening 9, especially by introducing a metal rod therein. The remaining portion of the feed pipe 10 can also be left within the lateral opening 9 and bent back in the upward direction from the exterior. Projected molten metal thus flows within the casting tube 5, obstructs the feed pipe 10 and forms a plug.

We claim:

1. A device for unchoking the casting outlet of a metallurgical vessel, said casting outlet being fitted with a vertical casting tube, wherein said device comprises an opening formed in the lateral wall of the casting tube, a feed pipe for supplying oxygen or a suitable gas which is intended to be introduced into the casting tube through the lateral opening aforesaid, means for guiding said feed pipe towards said casting outlet and stopping means for sealing-off the lateral opening aforesaid after said feed pipe is removed.

2. A device according to claim 1, wherein the lateral opening of the casting tube has a wall such that the portion adjacent to the interior of the tube is inclined towards the lower end of said tube.

3. A device according to claim 1, wherein means are provided for forming a neutral gas curtain opposite to the lateral opening of the casting tube internally or externally of said tube.

4. A device according to claim 1, wherein the means for guiding the feed pipe which serves to supply oxygen or the like comprise a funnel which readily melts in contact with the liquid metal and is inserted in the top portion of the casting tube, said funnel being flared towards the bottom of said casting tube.

5. A device according to claim 1, wherein the means for guiding the feed tube towards the casting outlet comprise an elbowed sleeve which readily melts in contact with the liquid metal, said sleeve being placed between the lateral opening of the casting tube and attached to the upper portion of said tube.

6. A device according to claim 1, in which the casting tube is formed of refractory material covered externally by a metal cladding, wherein said metal cladding entirely covers the walls of the lateral opening of the casting tube and wherein said stopping means is a plug of metal such that the portion in contact with the interior of the tube is capable of melting to a partial extent at the time of downward flow of the liquid metal.

7. A device according to claim 1, wherein the casting tube is provided with an internal lining of heat-insulating material containing inorganic particles which are sinterable at the time of downward flow of the liquid metal within the casting tube and wherein said stopping means is a plug fabricated from the same material as the internal lining of said casting tube.

8. A device according to claim 1, wherein said device comprises a lever attached to the casting tube, the extremity of said lever being adapted to cooperate in frictional contact with the oxygen feed pipe in order to permit engagement of said pipe within the interior of said casting tube.

9. A device according to claim 1, wherein the lateral wall of said device is provided with a nipple for connecting a pipe which serves to supply a neutral gas or a reducing gas.

* * * * *